US005906358A

United States Patent [19]

Baziuk et al.

[11] Patent Number: 5,906,358

[45] Date of Patent: May 25, 1999

[54] MONITORING OPERATION OF A WINCH

[75] Inventors: Morris Baziuk, Winnipeg; Jan Vetesnik, Lorette, both of Canada

[73] Assignee: Unique Concepts Ltd., Wpg, Canada

[21] Appl. No.: 08/955,972

[22] Filed: Oct. 22, 1997

[51] Int. Cl.[6] ..... B66D 1/00; B66D 1/48; G06M 3/02

[52] U.S. Cl. ..... 254/266; 235/103; 242/912; 254/276

[58] Field of Search ..... 254/276, 266; 242/912; 325/103

[56] References Cited

U.S. PATENT DOCUMENTS

| | | | |
|---|---|---|---|
| 169,117 | 10/1875 | Phinney | 235/103 |
| 2,661,187 | 12/1953 | Dailey | 254/134.3 FT |
| 3,500,391 | 3/1970 | Heske | 235/103 X |
| 3,548,165 | 12/1970 | Linnenkamp | 235/103 X |
| 4,361,312 | 11/1982 | Schreyer et al. | 254/276 |
| 4,403,867 | 9/1983 | Duke | 235/103 X |
| 5,344,121 | 9/1994 | Bziuk . | |

*Primary Examiner*—Michael Mansen
*Attorney, Agent, or Firm*—Adrian D. Battison; Murray E. Thrift

[57] ABSTRACT

A method of operating a winch having a winch drum mounted in a housing to reel in and pay out the cable over a plurality of repeated cycles of use during a period of use of the winch. A digital counter is mounted on the housing so as to be responsive to each rotation of the drum in both directions and arranged to generate a total count during the period of use which is indicative of the number cycles so that the winch can be taken out of operation for service when the number of rotations reaches a predetermined maximum. The digital counter includes a follower contacting a raised portion on an edge of the drum so as to be moved by the raised portion for actuating each count of the digital counter.

3 Claims, 3 Drawing Sheets

MONITORING OPERATION OF A WINCH

The invention relates a winch and to a method of monitoring operation of the winch to ensure safety of operation.

BACKGROUND OF THE INVENTION

In U.S. Pat. No. 5,344,121 of the present inventor there is disclosed a winch which is designed particularly for use in protecting a person entering an underground or unsafe area so that the person can be supported against falling and can be returned to a safe location in the event that the person becomes incapacitated.

Winches of this type are now mandated when a person enters an underground location such as a tank or pipe line to ensure that the person is not injured by falling while entering the location and to ensure that the person can be retrieved to the surface in the event that the person becomes incapacitated due to injury or noxious gases.

Winches of this type are carefully manufactured to particular tolerances and also are of the type which include a braking system so that the cable is held against further paying out once it is pulled. A manually operable handle cranks the winch drum in a direction to pay out the cable and in a direction to reel in the cable. In the paying out direction the handle is cranked to release the brake so as to allow the cable to be gradually paid out at a rate determined by the manual cranking of the drum rather than by the rate of pulling. The cable is therefore winched down into the underground location with the person generally as the person climbs down an entry ladder. In the event of falling, the brake holds the drum against further rotation in the paying out direction and allows the operator on the surface to crank the drum in the reeling in direction to pull the person back to the surface.

It is of course important in winches of this type that they be maintained in proper operating condition so that there is no breakdown in an emergency situation. It is generally therefore not satisfactory that the winch is merely be repaired when broken but that there be a proper service procedure and time table by which it is maintained in proper operating condition.

Up till now, such a servicing procedure has been based upon a time period so that it is proposed that the winch be returned for servicing after a predetermined period of time for example six months to ensure that servicing is of sufficient frequency to prevent breakdown.

However this simple statement has generally been found to be insufficient to ensure that servicing occurs on the mandated time period. Generally the winch it self does not carry any indication of the date for servicing so that it is quite possible that the winch remains in operation for a period long past the due date. Generally nothing on the winch itself confirms to the operator that it is beyond its due date for service and therefore the winch is continued to be used. In practice this system does not lead to a proper servicing of the equipment.

Secondly this system does not take into account different levels of usage. Some winches of this type are used heavily on a repeated basis and some are merely available for an emergency situation and therefore are used very infrequently. The specification of a predetermined time period for service does not take into account these different levels of usage.

SUMMARY OF THE INVENTION

It is an object of the present invention, therefore, to provide an improved winch and an improved method for servicing a winch which allows the winch to be maintained in a proper serviceable condition at all times.

According to the invention, therefore, there is provided a winch comprising:

a winch housing;

a winch drum mounted in the housing for rotation about an axis of the drum for reeling in and paying out a cable;

a drive member for driving rotation of the drum;

the drum being arranged for rotation to reel in and pay out the cable over a plurality of repeated cycles of use during a period of use of the winch;

and a digital counter mounted on the housing so as to be responsive to rotation of the drum, the digital counter being arranged to generate a total count during the period of use which is indicative of the number cycles.

Preferably the digital counter is arranged so as to be responsive to each rotation of the drum.

Preferably the digital counter is arranged so as to be responsive to each rotation of the drum during both movement in a direction for paying out the cable and in a direction for reeling the cable.

Preferably the drum includes a raised portion thereof located so as to move past the digital counter and wherein the digital counter includes a follower contacting the drum so as to be moved by the raised portion for actuating each count of the digital counter.

Preferably the follower comprises a roller.

Preferably the raised portion is provided on a axially facing surface of the drum such that the raised portion moves the follower of the digital counter in an axial direction.

Preferably the surface is provided on the peripheral edge of the drum.

Preferably the digital counter includes a counter face exposed at an opening in the housing and wherein there is provided a cover attached to the housing and covering the digital counter.

Preferably the counter face is located on a surface of the housing adjacent the drum and facing axially toward the drum, the opening being provided in a plate of the housing on one side of the drum and wherein the digital counter is mounted on a side of the plate opposite to the drum, the cover being mounted on the plate on the side thereof opposite the drum.

Preferably the drum includes a shaft having a receptacle thereon for a manually operable handle, the shaft having a brake thereon arranged to halt rotation of the drum in a direction to pay out the cable in the event of the pulling of the cable.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 3:
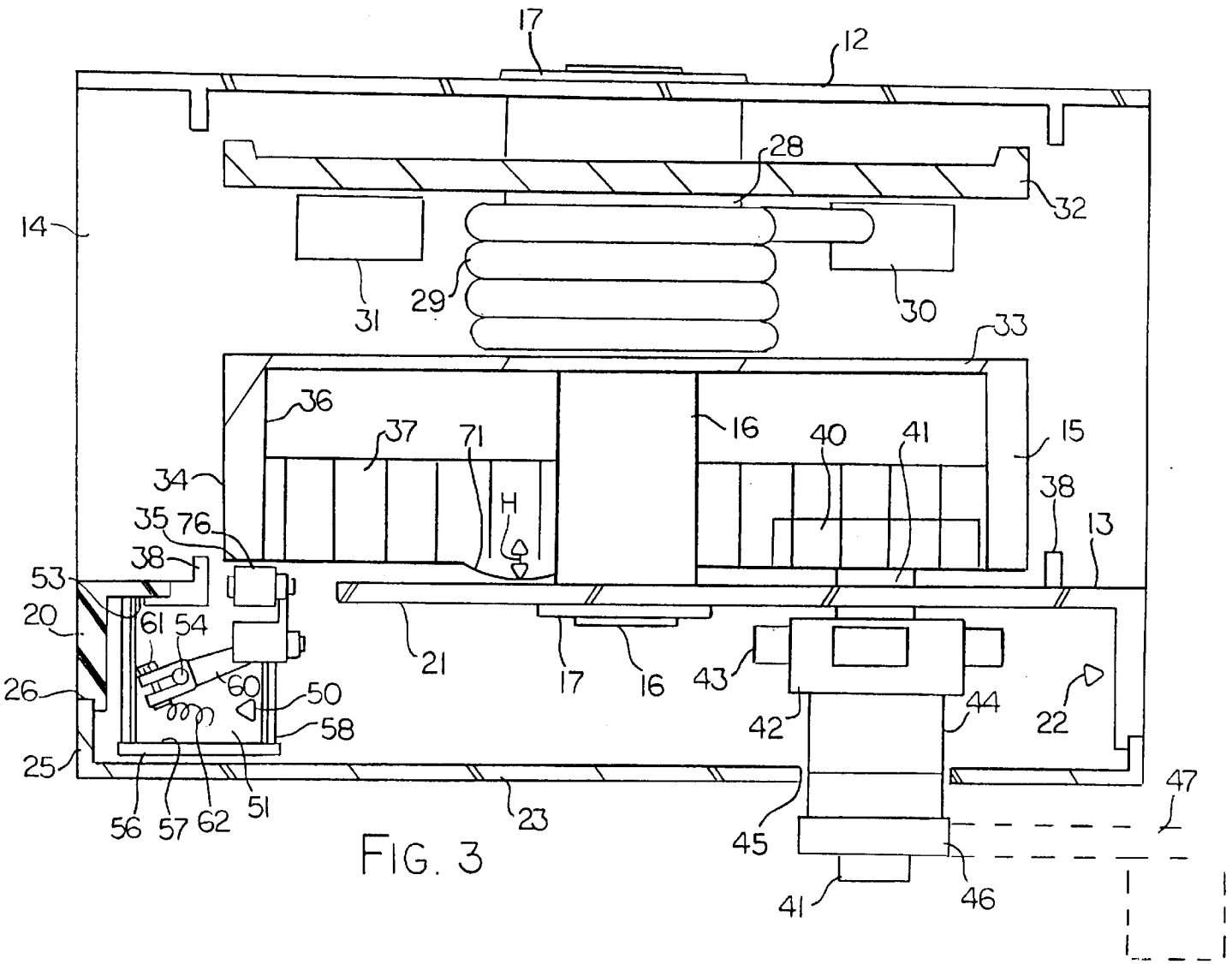
FIG. 3 is a cross sectional view along the lines 3, 3 of FIG. 2

A winch 10 comprises a housing 11 formed by a back plate 12, a front plate 13 and a base plate 14. The housing supports a drum 15 between the front plate and the back plate for rotation on a shaft 16 carried in bearings 17 on the front plate and the back plate. The front and back plates have an arched upper edge 18 and a flat bottom edge 19 with the latter attached to the flat base plate 14. The back plate 12 as best shown in FIG. 3 is substantially simply a flat plate. The front plate 13 includes a flange 20 which projects forwardly from a plate portion 21 so as to define a recess 22 for receiving operating elements of the winch. The recess is covered by a cover plate 23 having a flat plate portion parallel the plate 21 and a flange 25 co-operating with the flange 20 at an overlapping lip 26. The cover plate 23 is bolted to the plate 13 so as to maintain the recess 22 fully enclosed and the operating elements protected from tampering and damage.

The drum 15 includes a cylindrical core portion 28 on which a cable 29 is wound. The cable passes through one of a pair of holes 30, 31 in the base plate 14 so that the cable can be reeled in by rotation of the shaft and the drum in one direction and can be paid out by rotation of the shaft and drum in the opposed direction.

The drum includes a first side plate 32 adjacent to the back plate 12. The drum includes a second side plate 33 opposite to the side plate 32 and defining there between and annular receptacle for the cable 29 on the core portion 28.

The side plate 33 includes a cylindrical flange portion 34 extending axially away from the core portion 28 and the cable and surrounding the shaft 16. The cylindrical sleeve portion 34 has an end surface 35 facing axially away from the end plate 32. The cylindrical sleeve portion 34 has a hollow interior 36 with a plurality of gear teeth 37 facing inwardly of the surface 36. A cylindrical flange 38 is formed on the rear surface of the front plate 13 and surrounding the outside surface of the cylindrical portion 34.

A drive gear wheel 40 co-operates with the teeth 37 for driving the drum in rotation about the axis of the shaft 16. The gear wheel 40 is mounted on a shaft 41 carried in bearings on the plate 13. The shaft 41 carries a brake 42 which co-operate with pivotal pawls 43 mounted on the plate 13. The brake co-operate with a sleeve 44 surrounding the shaft 41 and projecting outwardly through a hole 45 in the cover 23. On the end of the sleeve 44 is provided a receptacle 46 for receiving manually operable handle shown schematically at 47. Rotation of the handle in one direction about the axis of the shaft 41 therefore drives the shaft 41 in the clockwise direction where the shaft is free to rotate and slip relative to the pawls 43 thus driving the drum in a direction to reel in the cable. Rotation of the handle in the opposite direction drives the brake 42 against the pawls 43 so that the drum is held against rotation in this direction unless the handle is driven in that direction sufficient to release the brake and thus allow the cable to be paid out.

A more detailed description of the brake construction is shown and described in the above mentioned U.S. Pat. No. 5,344,121 of the present inventor A winch of this type has been manufactured and sold for a number of years. The winch as shown in the drawings has a drive system which applies drive only directly through the shaft 41 to the drum. As shown in the above patent, an alternative arrangement includes a second shaft with a chain communicating from a gear wheel on the second shaft to a gear wheel on the shaft 41 so as to allow a two speed drive system. The present invention may be applied to either of these types of winch.

In accordance to the present invention, a winch as described above in modified by the addition of a digital counter 50. The digital counter 50 includes a body 51 having a plurality of counter wheels 52 mounted within the counter body and exposed at a face 53 of the counter body. The counter is driven by a top shaft 54 so that reciprocation of the shaft 54 about a vertical axis through an angle of the order of 45° causes incremental movement of the counter wheels to effect counting of a total of the number of reciprocations of the shaft 54. A reset screw 55 is provided on the bottom of the counter body and can be manually rotated to reset the counter wheels back to zero. The counter body includes a back plate 56 which covers a surface 57 of the body opposite to the face surface 53 with a back plate extending to each side of the body so that the body can be fastened to the plate portion 21 of the front plate 13 by four screws 58.

The shaft 54 is operated in its reciprocating movement by a lever 60 clamped onto the shaft 54 by a screw 61 so that the lever 60 projects outwardly to one side of the shaft. A spring 62 is attached to the clamping screw 61 and pulls the lever 60 in a counter clockwise to an initial position from which it is moved to effect counting of the strokes of reciprocation.

The lever 60 is actuated by a cranking mechanism generally indicated at 70 which co-operate with a raised portion 71 on the edge 35 of the cylindrical portion 34. The cranking mechanism includes a mounting block 72 which is attached to the plate portion 21 of the front plate 13 at an opening 73 in the plate portion. The mounting block 72 carries a lever 74 mounted on a shaft 75 for rotation about an axis which is parallel to the plate portion 21 and parallel to the bottom edge of that plate portion. The lever carries a roller 76 which rolls on the surface 35 and is pressed against that surface by the spring 62 communicating forces to the lever 60 which pushes against the lever 74 and thus pivots the lever 74 toward the surface 35. The roller 76 is mounted a pin 77 carried on the lever 74. The pin 77 is below shaft 75 and above the lever 60.

The raised portion 71 extends axially from the surface 35 by a height H which is sufficient to effect movement of the lever 74 to cause the reciprocation of the lever 60 to actuate a counting operation of the counter.

Each rotation of the drum therefore whether occurs in the pay out direction or the reel in direction causes the raised portion 71 to pass the lever 74 once for each rotation thus effecting an increment in the counter of one for each rotation.

Figure 1:
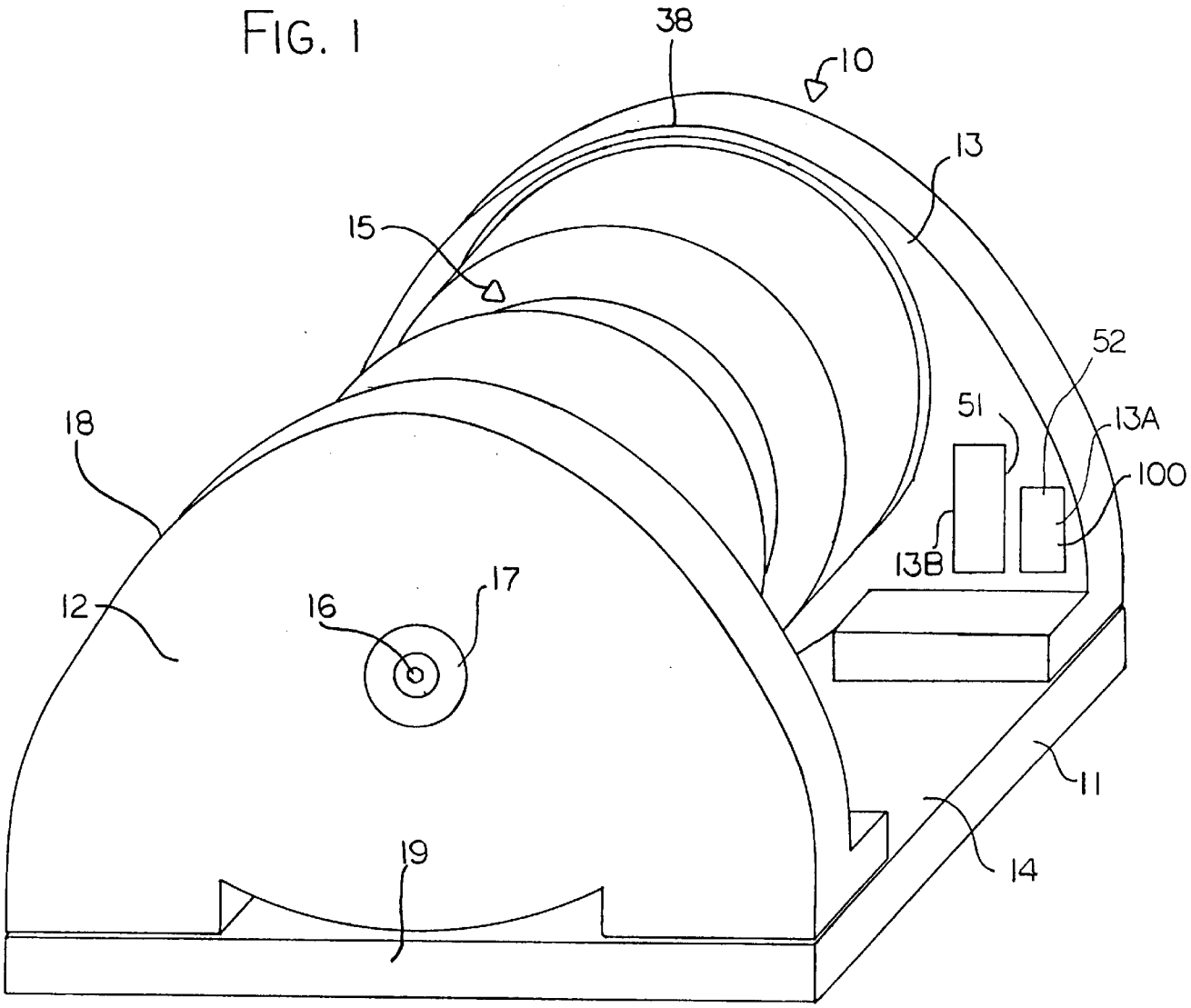
FIG. 1 is isometric view from the rear and one side of a winch according to the present invention
Figure 2:
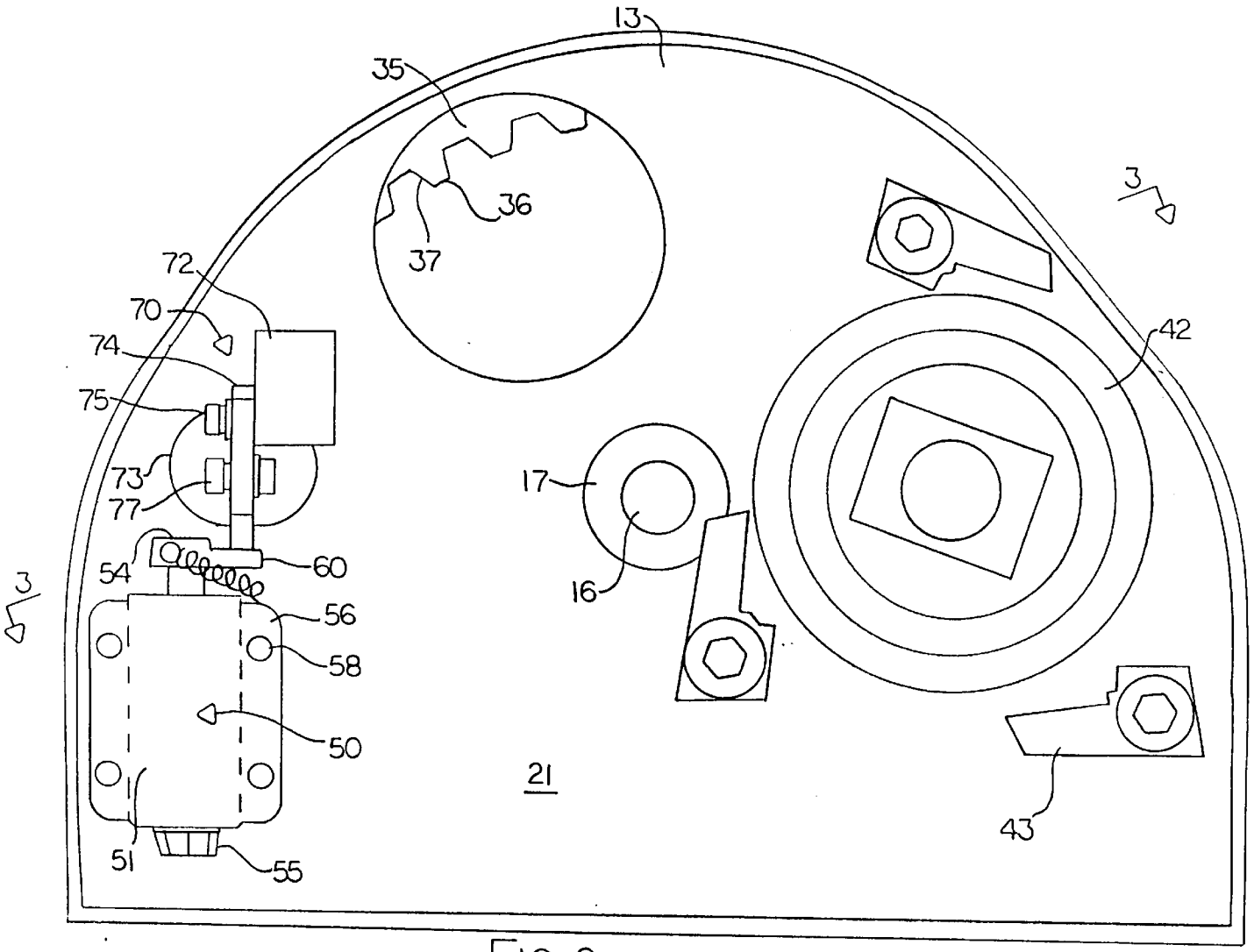
FIG. 2 is a front elevational view with the cover removed of the winch of FIG. 1

As shown in FIG. 1, the plate 13 includes a portion 13A thereof which extends outwardly from the flange 38 in the area adjacent the base plate 11 so as to form a generally triangular area on the inwardly facing surface of the plate 13. The counter face 51 is provided at an opening 13B in the portion 13A of the plate 13. The counter wheels are therefore readily available in this area so as to provide a total count of the number of rotations of the drum. The lever mechanism operating the counter, the counter body and the manually operable screw of the counter body are all protected in the interior 22 of the front plate 13.

In operation, the winch is repeatedly used during a period of operation for a plurality of cycles in which the cable is paid out and reeled in each times a person enters and area from which they are to be protected. Each pay out and reel in will cause a rotation of the drum through a number of turns of the drum depending upon the distance in which the person moves. The number of cycles and the number of turns of the drum in each cycle cause a predetermined amount of wear on the winch. The counting of the number of turns therefore provides an indication of this wear which is an indication of the number of cycles through which the winch has been used and the actual number of turns of the drum. When the counter reaches a predetermined maximum number, the winch clearly indicates this number on the visible counter. A label immediately adjacent the counter provides an indication of the maximum number of rotations which are acceptable before the winch needs to returned for service. The label is indicated at 100 and indicates the maximum number together with the requirement that the winch be returned for service.

It is immediately apparent therefore to a user of the winch when the maximum number of operations has been exceeded so that the user is inhibited from using the device and it is clear to the user that a liability is incurred by using the device beyond its stated allowable number of operations.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

We claim:

1. A method of servicing a safety winch comprising:

providing a safety winch having;

a winch housing;

a winch drum mounted in the housing for rotation about an axis of the drum in a first direction for paying out a cable and in a second opposite direction for reeling in the cable;

and a drive member for driving rotation of the drum;

operating the safety winch over a plurality of repeated cycles of use of the safety winch during a period of use of the winch;

in each cycle of operation of the winch, rotating the drum in the first direction to pay out the cable and subsequently in the second direction to reel in the cable;

providing a counter on the safety winch and using the counter to generate a cumulative count during the period of use which is indicative of the number cycles;

and when the cumulative count reaches a pre-determined level, taking the winch out of operation for service.

2. A method of servicing a safety winch comprising:

providing a safety winch having;

a winch housing;

a winch drum mounted in the housing for rotation about an axis of the drum in a first direction for paying out a cable and in a second opposite direction for reeling in the cable;

and a drive member for driving rotation of the drum;

operating the safety winch over a plurality of repeated cycles of use of the safety winch during a period of use of the winch;

in each cycle of operation of the winch, rotating the drum in the first direction to pay out the cable and subsequently in the second direction to reel in the cable;

providing a counter on the safety winch responsive to each rotation of the drum and using the counter to generate a cumulative count during the period of use of a total number of rotations of the drum in the plurality of cycles;

and when the cumulative count reaches a pre-determined level, taking the winch out of operation for service.

3. The method according to claim 2 including arranging the counter so as to be responsive to each rotation of the drum during both movement in said first direction for paying out the cable and in said second direction for reeling the cable.

* * * * *